US007126882B1

(12) United States Patent
Lowell

(10) Patent No.: US 7,126,882 B1
(45) Date of Patent: Oct. 24, 2006

(54) CUCKOO CLOCK HAVING SCISSORING EXTENSION ARM AND ACTUATING MECHANISMS

(76) Inventor: Judah Lowell, 3833 Winthrop Dr., Lexington, KY (US) 40514

( * ) Notice: Subject to any disclaimer, the term of this patent is extended or adjusted under 35 U.S.C. 154(b) by 0 days.

(21) Appl. No.: 11/449,124

(22) Filed: Jun. 8, 2006

(51) Int. Cl.
*G04B 19/06* (2006.01)
*G04B 21/00* (2006.01)

(52) U.S. Cl. ..... 368/229; 368/272

(58) Field of Classification Search ..... 368/75, 368/76, 223, 229, 269, 272–275
See application file for complete search history.

(56) References Cited

U.S. PATENT DOCUMENTS 2,054,677 A * 9/1936 Lux ..... 368/229
2,677,228 A * 5/1954 Wilhelm et al. ..... 368/272
3,918,249 A * 11/1975 Masuyama ..... 368/272
4,098,068 A * 7/1978 Masuyama ..... 368/272
4,993,006 A * 2/1991 Oshima et al. ..... 368/231

* cited by examiner

*Primary Examiner*—Vit W. Miska
(74) *Attorney, Agent, or Firm*—Stockwell & Smedley, PSC

(57) ABSTRACT

A cuckoo clock having a scissored extension arm is disclosed. The clock, using the arm, provides an attractive visual display with minimum displacement and shift of center of gravity.

27 Claims, 6 Drawing Sheets

CUCKOO CLOCK HAVING SCISSORING EXTENSION ARM AND ACTUATING MECHANISMS

FIELD OF THE INVENTION

The present invention relates to cuckoo clocks, and more particularly to a scissoring extension arm which provides an attractive visual display.

BACKGROUND OF THE INVENTION

Cuckoo clocks can have a variety of displays and movement mechanisms. Such displays and mechanisms can enhance the ornamental value of the clock. However, adapting a cuckoo clock to have a scissoring extension arm has proven difficult, as operating the arm incurs a substantial reduction in the stored energy of the clock, unwanted shifts in the center of gravity of the clock as a whole, and a mechanical complexity which has proven difficult to solve. Consequently, an improved scissoring extension and actuating mechanisms for cuckoo clocks is desired.

DETAILED DESCRIPTION OF THE PREFERRED EMBODIMENTS

Before explaining the disclosed embodiment of the present invention in detail it is to be understood that the invention is not limited in its application to the details of the particular arrangement shown, since the invention is capable of other embodiments. Also, the terminology used herein is for the purpose of description and not of limitation.

Figure 1:
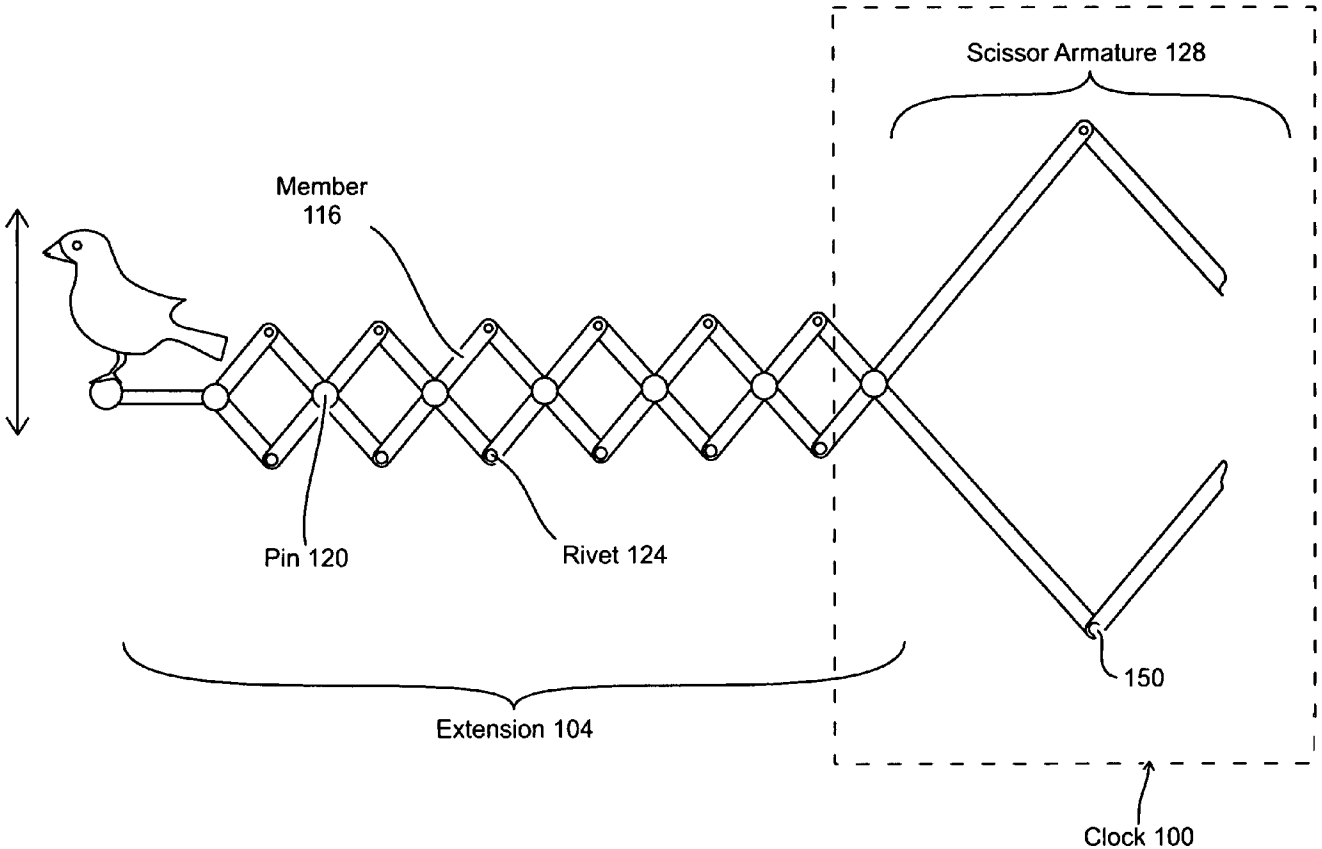
FIG. 1 shows a side view of an exemplary embodiment of the present invention, attached to a cuckoo clock.

FIG. 1 shows a scissoring extension 104 which is operated within a cuckoo clock 100 and is extended and withdrawn at specific intervals. The scissoring extension 104 can hold an ornamental object, such as but not limited to a cuckoo bird. The cuckoo bird can be adapted to move in various directions, including but not limited to vertical.

As shown in FIG. 1, the scissoring extension 104 securely attaches to the cuckoo clock 100 via a scissor armature 128. This armature 128 can comprise a combination of screws, bolts, and rivets, for example, although other fastening brackets are contemplated within the spirit and scope of the present invention.

The materials used within the scissoring extension 104 are chosen so as to minimize the weight added to the clock 100. Additionally, the clock 100 can accommodate this additional weight by being fastened not merely to the plaster or drywall, but instead being more permanently fastened directly to a stud within a wall Specifically, as shown in FIG. 1, the scissoring extension 104 contains a plurality of small members 116, pins 120, and rivets 124. The members 116 can be composed of a lightweight material such as durable high-fiber content plastic, or other materials. The pins 120 must be able to withstand a significant amount of torsion. This is true both when the scissoring extension 104 is in its retracted as well as extended positions, as a significant amount of potential energy will bear thereupon in either case. Separately, when the scissoring extension is moving through its various extended positions, some torsion will be exerted on the pins 120. Thus, the pins 120 should be of a material that can withstand significant torsion, yet not build up resistance to movement. Also, because some cuckoo clocks go uncleaned for as long as 5 and 10 years, the members 116, pins 120, and rivets 124 should be built from a material that will not build up or accumulate grit or other impediments to unrestricted motion.

The scissor armature 128 can be made of the same material as the small members 116, but could also be made of a different material. The scissor armature 128 must operate in narrow, confined channels. This is because other portions of the cuckoo clock 100 take up a significant amount of space.

Figure 2:
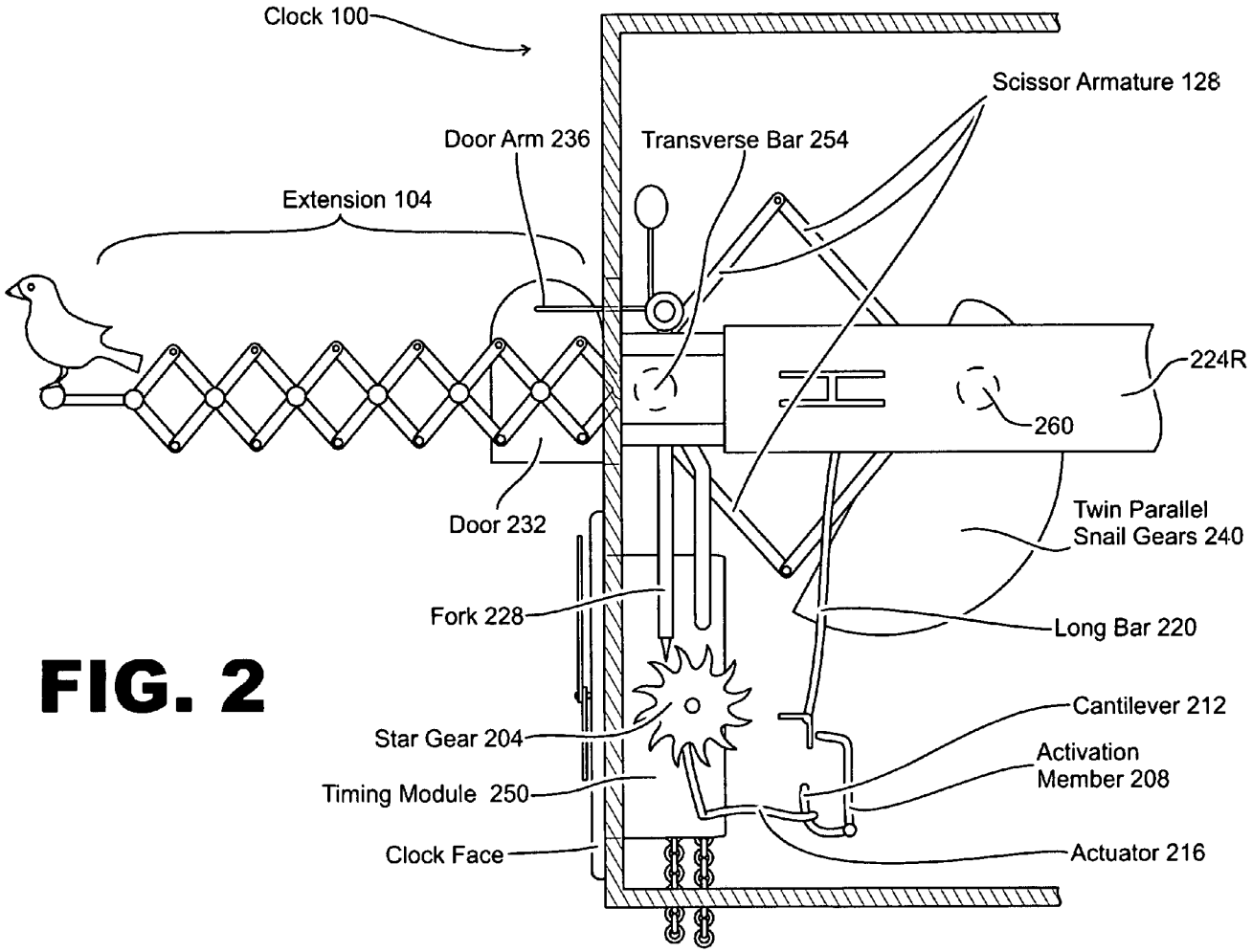
FIG. 2 shows a modified side view of the embodiment shown in FIG. 1.
Figure 3:
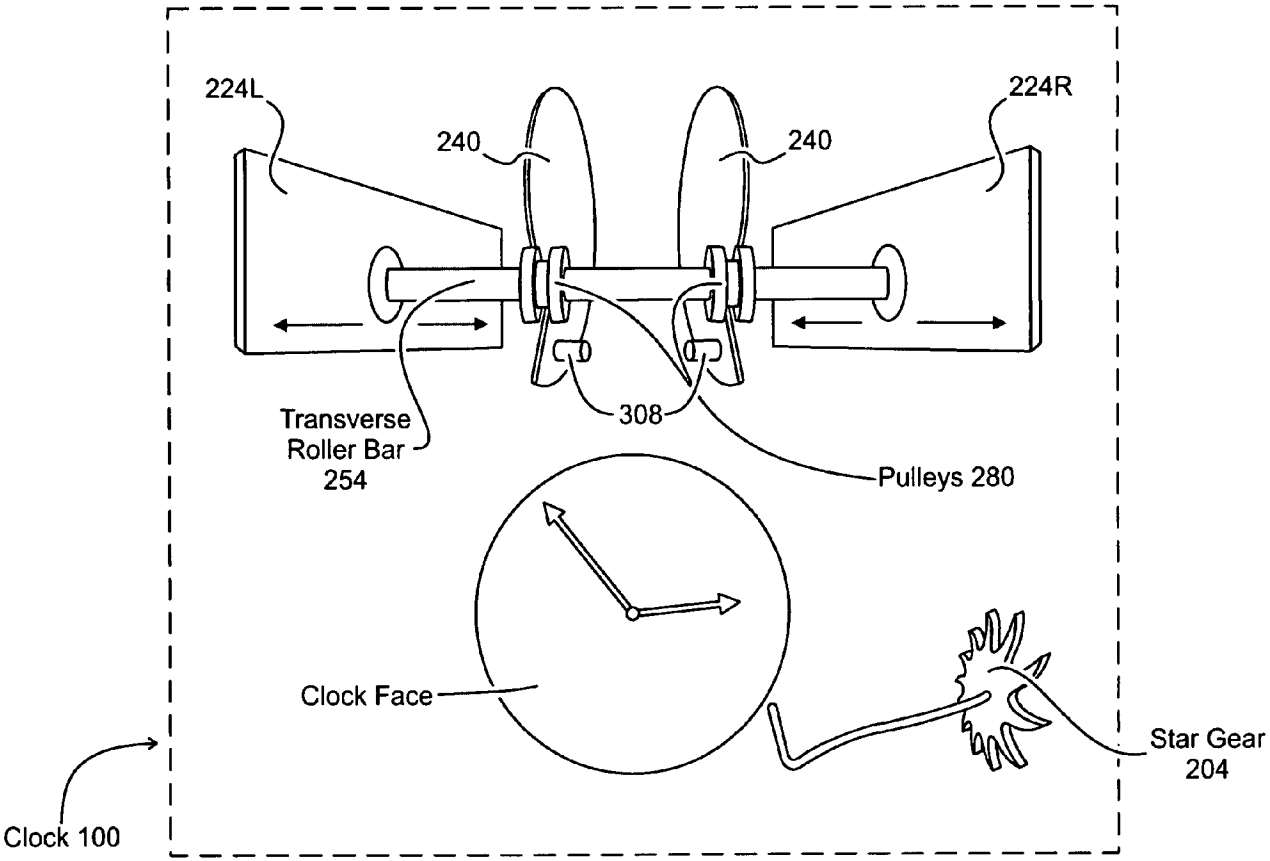
FIG. 3 shows an additional view of the embodiments shown in FIGS. 1 and 2.
Figure 4:
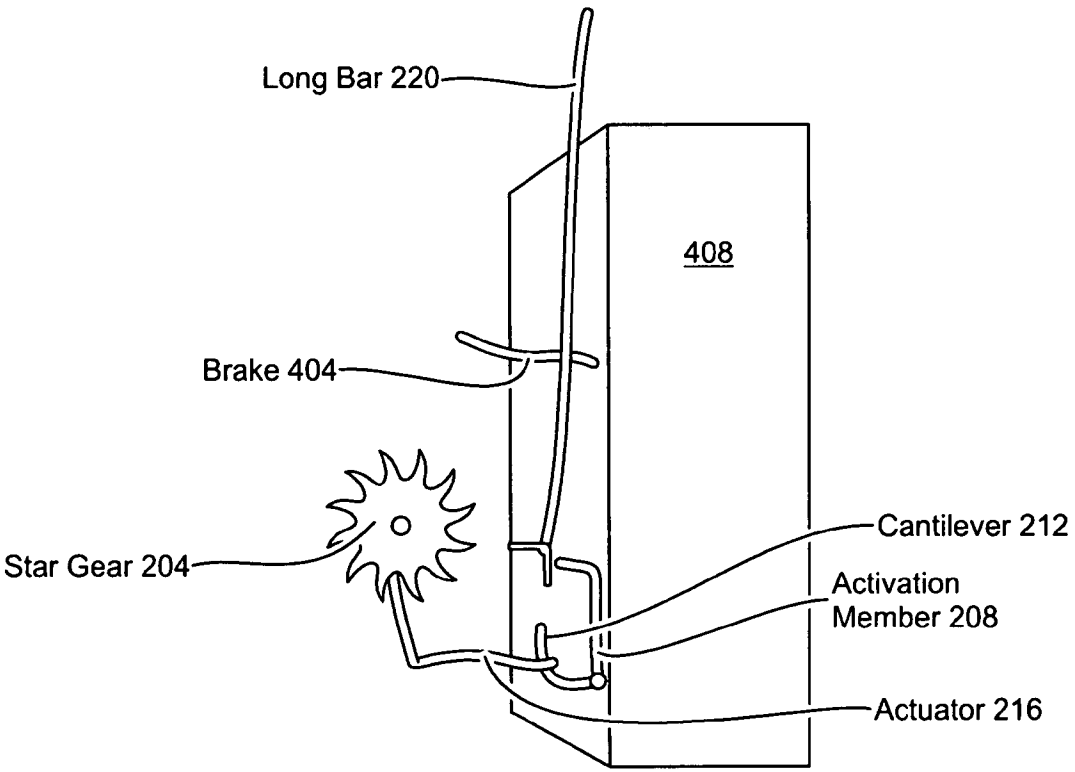
FIG. 4 shows yet another view of the embodiments shown in FIGS. 1–3.

FIGS. 2–4 show various views of the interior mechanisms of the clock 100. Not all portions of the clock 100 are shown in FIGS. 2–4, nor are all mechanical connections depicted. Instead, various elements of the clock 100 are shown suspended in space, so that an observer can have an unobstructed view of the physical relationships between the different elements. None of FIGS. 2–4 are intended to be a depiction of all or even a majority of the elements within the clock 100, so that the present should not be considered as limited exclusively thereto.

Turning to FIG. 2, a timing module 250 manages the non-ornamental, timekeeping aspects of the clock 100. The timing module 250 can have a variety of constructions, comprising for example both mechanical and/or electronic components. For the purposes of the present invention, the timing module 250 has three important functions. The first function is to initiate a cuckoo display event at the correct time, the second function is to control how long the cuckoo stays outside of the clock 100, and the third function is to trigger the correct amount of cuckoo sounds.

The scissoring extension 104 travels back and forth solely in a linear path, which is guided by twin sliding guides 224R (shown in FIG. 2) and 224L (not visible in FIG. 2). The sliding guides 224R and 224L sit on either side of the scissoring extension 104 and are fixedly secured within the interior of the clock 100. A transverse roller bar 254 having roller mechanisms at each end is movably secured within the guides 224R and 224L. The transverse roller bar 254 is connected to both the scissoring extension 104 and the scissor armature 228.

An actuator 216 is connected to the timing module 250. The actuator 216 mechanically communicates with an activation member 208 that is joined with a cantilever 212. The activation member 212 can be in temporary contact with the actuator 216. As shown in FIG. 4, the cantilever 208 makes temporary contact with a brake 404 extending from the long member 220. This in turn alerts the flywheel housing 408 which is a series of gears that releases and allow the snail gear to rotate and extend the scissor armature 128.

The cuckoo bird and scissoring extension 104 move through a door 232 which opens and closes on a hinge. Prior to a cuckoo display event, a door arm 236 serves to open and close the door 232.

The clock face is positioned at the front of the clock 100, and can be either above, below, or adjoining the door 232 and cuckoo bird. In FIG. 2 the clock face is shown below the door 232, but as stated FIG. 2 is for exemplary purposes only, so that the present invention should not be considered as limited exclusively what is shown therein.

A pair of snail gears 240, arranged in parallel, are affixed to the interior of the clock 100. These snail gears 240 move with a rotary shaft 260 that is rotatably fixed within the clock 100 and thus does not move laterally, but instead only rotates. The snail gears 240 also occasionally contact the transverse roller bar 254, doing so through a pair of roller bar pulleys (not shown) which are permanently affixed to and rotate at the same rate as the transverse roller bar 254. These snail gears 240 are manufactured in an elliptical oval shape so as to impel the transverse roller bar 254 forward.

The twin snail mechanisms 240 are carefully fabricated so that they cannot shake loose or come out of alignment with each other, or with the rotary shaft 260. This is because the snail gears 240 are held into place not only by a friction fit, but also an eccentric screw (not shown) that allows no movement independent of that achieved by the rotary shaft 260, regardless of height/torque ratio.

A star gear 204 is connected to the timing module 250. The star gear 204 can have varying numbers of teeth. A scissor armature 128 is connected to the scissoring extension 104, and also to the transverse roller bar 254. The scissor armature 128 provides lateral stability and mechanical guidance to the scissoring extension 104. The scissor armature 128 is not directly connected to the snail gears 240, although they are in close proximity.

A fork 228 is located above the star gear 204. At times the lower end of the fork 228 is connected to the star gear 204. As shown in FIG. 2, the upper end of the fork 228 is rotatably affixed to an area directly above the star gear 204.

The transverse roller bar 254 cannot spring rearward until it is released by the fork 228. The duration of the cuckoo display is counted out by the timing module 250, with the fork 228 as sentinel or gatekeeper or release agent. The timing module 250 informs the star gear 204 when it is acceptable to release the fork 228.

FIG. 3 shows another view of the transverse roller bar 254, snail gears 240, pulleys, and sliding guides 224R and 224L, as they relate to the clock face and the star gear 204.

FIG. 4 shows more detail of the flywheel housing 408, and how it is physically located with respect to the long member 220 and brake 404. Additionally, the physical proximity of the cantilever 208 and the brake 404 is shown.

The flywheel housing 408 is also shown in FIG. 4, and is connected to a series of gears (not shown) that allow the snail gears 240 to rotate, thereby pushing out the scissor armature 128. The flywheel housing 408 contains a flywheel (not shown). A brake 404 attached to the long bar 200 sometimes abuts against the flywheel.

During a cuckoo display event, the transverse roller bar 254 occupies its forward position. At this time, various types of springs (not shown) continually urge the transverse roller bar 254 to return to its rearward position. However, the fork 228 serves to temporarily block the transverse roller bar 254 from returning, until a predetermined interval of time elapses.

The embodiments shown in FIGS. 1–4 are for exemplary purposes only, and the present invention should not be considered as limited exclusively thereto. Other means of effectuating the cuckoo movement are also contemplated within the spirit and scope of the present invention, including but not limited to a programmable microcontroller, electronic solenoid activators, and electromagnetic mechanisms. Also, as stated, the clock face is positioned at the front of the clock 100, and can be either above, below, or adjoining the door 232 and cuckoo bird. Thus, the present invention can be implemented in a variety of means not explicitly shown in the Figures herein.

Using the embodiment of the present invention shown in FIGS. 1–4 as an exemplary embodiment only, the clock 100 of the present invention works as follows.

First Stage (of Three Stages) of Clock Action: Extending

The timing module 250 puts out a signal that a cuckoo display event is impending, thereby causing the actuator 216 to pivot to a leftward direction (leftward as seen within FIG. 2). This pivoting action pulls down the cantilever 212, which, as stated, is physically joined to the activation mechanism 208. The mechanism 208 then pushes down on the brake 404.

The long bar 220 that extends down from the top and holds the brake 404, then releases the flywheel housing 408. This in turn allows the snail gears 240 to begin rotating. As the snail gears 240 complete their rotation, they push out the scissor armature 128. This has the effect of locking the fork 228 into the star gear 204. At this time, both scissoring extension 104 and scissor armature 128 are in their fully extended positions. Also at this time, the transverse roller bar 254 is in its forward position.

Second Stage (of Three Stages) of Clock Action: Holding Stationary

The twin snail gears 240 rotate until they come to the locking pins 150 located on the bottom portion of the scissor armature 128. Meanwhile, the timing module 250 operates a cuckoo sound mechanism (not shown) for a predetermined amount of cycles. When the desired number of cuckoos is achieved, the timing module 250 releases the fork which allows the snail gears 240 to rotate around and lift the locking pins 150, which moves the brake 404, thereby stopping the snail gears 240.

During operation of the present invention, the cuckoo comes out, stays out to tick off the required count of cuckoo noises, and then returns. Thus, during a single cuckoo display event, the cuckoo does not come out, return, come out again, return again, etc.

Third Stage (of Three Stages of Use): Retracting

Upon receipt of a "cuckoo display completed" signal from the timing module 250, the star gear 204 releases and allows the fork 228 to fall back. This in turn allows the scissor armature 128 to unlock and be subject to the pull of the springs (not shown), thereby relocating the transverse roller bar 254 into its rearward position. This action also releases the snail gears 240, thereby allowing the snail gears 240 to slowly rotate upward and eventually lock the long member 220, which connects down to the brake 404, thereby stopping the flywheel contained within the flywheel housing 408.

While the clock 100 is making cuckoo sounds, the star gear 204 does not rotate. Only when the cuckoo sounds are completed doe the star gear 204 move. The snail gears 240 will continue to turn even after the roller bar 254 is pulled into its rearward position. The transverse roller bar 254 acts as a locking device for the scissor arm 128 and snail gear 240. Thus, once the fork is released the fork falls back and releases the snail to rotate until it is stopped by the brake 404.

The snail gears 240 each have cantilevered members 308 attached thereto, facing inward. After the scissor armature 128 returns to its closed position, the locking pins 150 of the scissor armature 128 abuts against these cantilevered members for a brief period. The snail gears 240 then rotate back into their stored, inactive position.

Other Factors of the Present Invention

During operation of the present invention, the center of gravity of the overall clock 100 can be shifted to some extent. The present invention can compensate for this shifting via, for example, a counterweight located in the rear area of the clock 100.

Most cuckoo clocks are operated by a series of hanging weights, which can resemble pine cones. The weights are originally hung at a high position. As the clock operates, the weights drop down to a low position. Eventually, the weights need to be pulled back up to a high position, using a series of chains and pulleys, so as to re-establish their potential energy. The exact number of weights, chains, and pulleys can vary from one clock to another. However, as will be described in more detail herein, a cuckoo clock can also be operated by some other type of power source such as a battery or wall outlet.

To operate many cuckoo clocks, the weights drop slightly and in doing so provide a mechanical pulling force which the clock mechanisms translate into energy used to operate the clock, via a variety of translation mechanisms. The present invention is carefully calibrated to minimize the loss of potential energy stored within the hanging weights. Because only a limited amount of potential energy can be stored in this fashion, the present invention minimizes the amount of energy expended by the scissoring extension 104, snail gears 240, and the other movable parts.

This minimization can be achieved by, for example, use of lighter weight materials for the scissor members 116, such as brass, nickel, aluminum, or high durability plastic.

Electrical/Electronic Embodiment of the Invention

The above embodiments discussed above were largely directed at a mechanical-only embodiment. However, several electrical/electronic solutions are contemplated within the spirit and scope of the present invention. The present invention can also be installed in a clock that does not have the hanging weights, but instead has a battery, a power cell, some other rechargeable device, or is connected directly to an electrical source.

Figure 5:
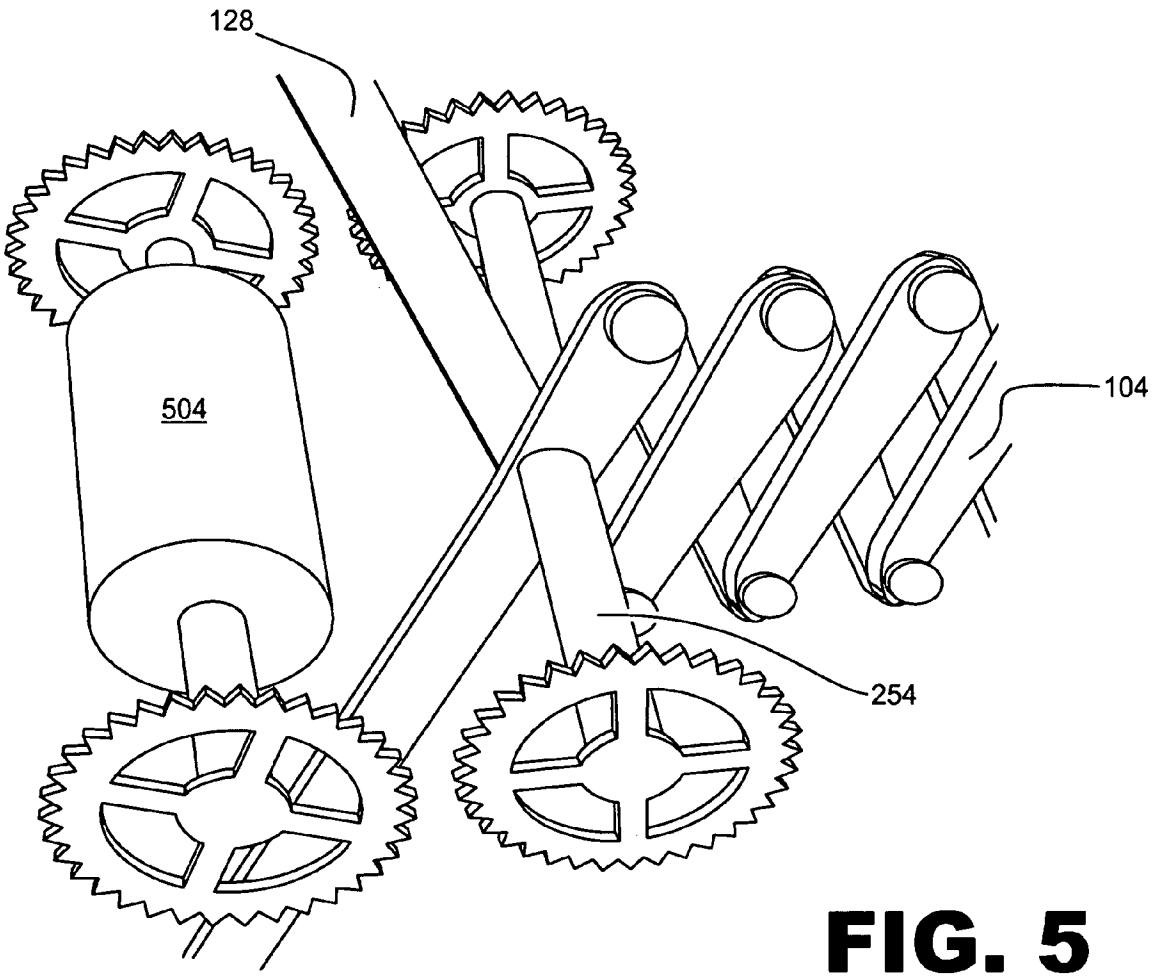
FIG. 5 shows an alternative embodiment of the present invention.

As shown in FIG. 5, a motor 504 can be substituted for the spring/release means of FIGS. 1–4. This motor 504 will be responsive to the timing module 250. Such a configuration has the advantage of reducing manufacturing cost, increasing reliability, and utilizing significantly less parts. For example, the star gear 204, fork 228, long bar 220, actuator 216, actuating member 208, cantilever 212, and potentially other parts are not needed, as the timing module 250 can deliver extend/collapse signals directly to the electric motor 504.

For simplicity, the embodiment shown in FIG. 5 has several parts omitted. However, the main principles of the motorized embodiment of the present invention are visible from FIG. 5, wherein the motor 504 is mounted directly to the interior of the clock 100 in such a way that the motor 504 rotates but does not move laterally. Instead, the gears attached to the motor 504 translate their energy to the gears associated with the transverse roller bar 254, which does move laterally. These gears provide the energy for the scissored extension 104 to extend and withdraw.

Figure 6:
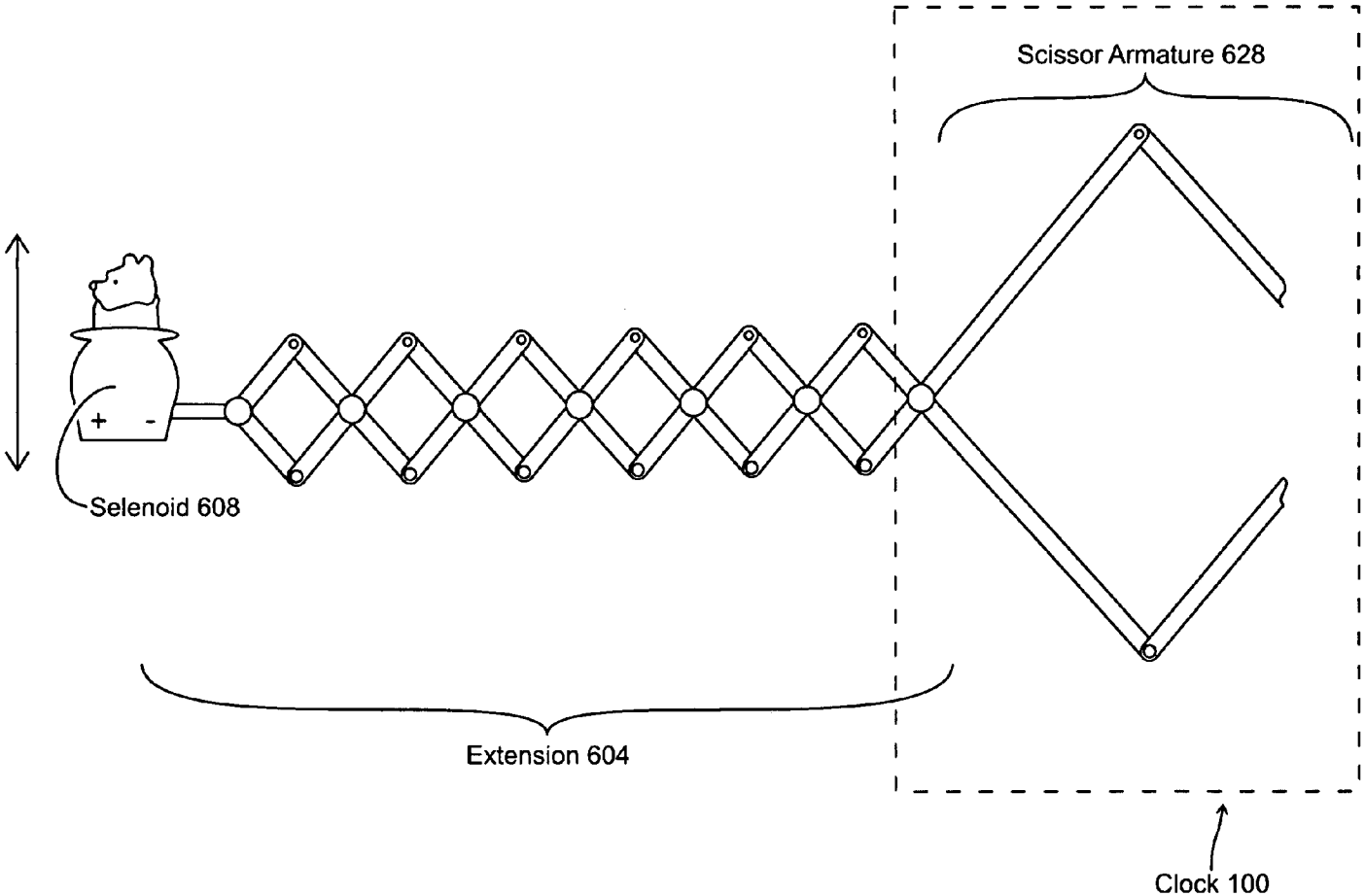
FIG. 6 shows an additional alternative embodiment of the present invention.

FIG. 6 shows another embodiment of the present invention. A POOH™ figure is substituted for the cuckoo bird of FIG. 1, and the extension 604 and scissor armature 628 are capable of carrying electrical signals. This can be accomplished, for example, by fabricating either or both of extension 604 and armature 628 from a PC board material. Such a feature can be useful, for example, to carry electrical signals to the device at the end of the extension 604. One such device is a honey jar. Using a solenoid 608, the POOH™ figure can be made to move up and down while the extension 604 is in its fully-expanded configuration.

The various aspects of the present invention has been described in detail with particular reference to preferred embodiments thereof, but it will be understood that variations and modifications can be effected within the spirit and scope of the invention as described herein. It is anticipated that various changes may be made in the arrangement and operation of the system of the present invention without departing from the spirit and scope of the invention, as depicted in the following claims.

What is claimed is:

1. A cuckoo clock having a scissored extension for displaying an ornamental object, comprising:

a three-dimensional housing, having a clock face;

a timing module connected to the housing, responsible for initiating a cuckoo display event at a predetermined time, controlling how long the cuckoo stays outside of the clock, and triggering the correct amount of cuckoo sounds;

a scissor armature, connected to the housing and the timing module;

a scissoring extension connected to the scissor armature, for displaying an ornamental object which travels back and forth solely in a linear path, wherein that path is determined by twin sliding guides which are located on either side of the scissoring extension and are fixedly secured within the interior of the clock; and a transverse roller bar having roller mechanisms at each end movably secured within the guides, and connected to both the scissoring extension and the scissor armature;

wherein the scissoring extension is also connected to the transverse roller bar.

2. The clock of claim 1, further comprising:

an actuator connected to the timing module, which mechanically communicates with an activation member joined with a cantilever, wherein the cantilever makes temporary contact with a brake extending from a long member;

a flywheel housing, which can release and allow the snail gear to rotate and extend the scissor armature;

a pair of snail gears, arranged in parallel, affixed to the interior of the clock via a rotary shaft that is rotatably fixed within the clock and thus does not move laterally but only rotates; and a star gear connected to the timing module, for releasing the transverse roller bar.

3. The clock of claim 2, further comprising:

wherein the snail gears are manufactured in an elliptical oval shape so as to impel the transverse roller bar forward.

4. The clock of claim 2, further comprising:

the snail gears intermittently contacting the transverse roller bar so through a pair of roller bar pulleys which are permanently affixed to and rotate at the same rate as the transverse roller bar.

5. The clock of claim 2, further comprising:

snail gears being fabricated so that they cannot shake loose or come out of alignment with each other, or with the rotary shaft.

6. The clock of claim 5, further comprising:
the snail gears being held into place by a friction fit, and by an eccentric screw that allows no movement independent of that achieved by the rotary shaft.
7. The clock of claim 5, further comprising:
the scissor armature providing lateral stability and mechanical guidance to the scissoring extension.
8. The clock of claim 2, further comprising:
a fork, located above the star gear, wherein the lower end of the fork is connected to the star gear;
further wherein the transverse roller bar cannot move rearward until it is released by the fork;
further wherein the duration of the cuckoo display is counted out by the timing module, with the fork as timing release agent.
9. The clock of claim 8, further comprising:
the timing module informing the star gear when it is acceptable to release the fork.
10. The clock of claim 2, further comprising:
the flywheel housing being connected to a series of gears that allow the snail gears to rotate, thereby pushing out the scissor armature.
11. The clock of claim 2, further comprising:
the flywheel housing containing a flywheel.
12. The clock of claim 2, further comprising:
a brake attached to a long bar intermittently abutting against the flywheel housing.
13. The clock of claim 1, further comprising:
a plurality of springs for continually urging the transverse roller bar to return to a rearward position.
14. The clock of claim 9, further comprising:
the fork serving temporarily block the transverse roller bar from returning, until a predetermined interval of time elapses.
15. The clock of claim 1, further comprising:
a battery, power cell, or other rechargeable device connected to the clock.
16. The clock of claim 1, further comprising:
the clock being connected directly to an electrical source such as a wall outlet.
17. The clock of claim 1, further comprising:
the ornamental object being a cuckoo bird.
18. The clock of claim 1, further comprising:
the ornamental object being a POOH™ figurine.
19. The clock of claim 1, further comprising:
the scissoring extension containing a plurality of small members, pins, and rivets.
20. The clock of claim 19, further comprising:
the members being composed of a lightweight material such as durable high-fiber content plastic.
21. The clock of claim 20, further comprising:
the members, pins, and rivets being built from a material that will not build up or accumulate grit.
22. The clock of claim 20, further comprising:
the timing module having both mechanical and/or electronic components.
23. The clock of claim 1, further comprising:
the extension and scissor armature being capable of carrying electrical signals.
24. The clock of claim 18, further comprising:
the figurine moving via a solenoid.
25. The clock of claim 1, further comprising:
the timing module being of an electrical/electronic format;
an electric motor connected to the transverse roller bar, and responsive to signals from the timing module; wherein
the timing module can electrically control the various movements of the transverse roller bar, by sending signals to the electric motor.
26. A method of operating a cuckoo clock, comprising:
signaling that a cuckoo display event is impending;
pivoting an actuator in a predetermined direction;
pulling down a cantilever which is physically joined to an activation mechanism;
pushing down on a brake;
releasing a flywheel; thereby
allowing snail gears to begin rotating;
providing a scissor armature connected to a scissoring extension and a transverse roller bar;
as the snail gears complete their rotation, pushing out the scissor armature; thereby
locking a fork into a star gear; thereby
holding both the scissoring extension and scissor armature in a fully extended position;
rotating the snail gears until they come to locking pins located on the bottom portion of the scissor armature; while simultaneously
operating a cuckoo sound mechanism for a predetermined amount of cycles;
releasing a fork when the desired number of cuckoos is achieved;
signaling that a cuckoo display event is completed;
releasing the fork; thereby
allowing the scissor armature to unlock and be subject to the pull of springs; thereby
relocating the transverse roller bar into its rearward position.
27. The method of claim 26, comprising:
releasing the snail gears to slowly rotate upward and eventually lock a long member connected to the brake; thereby
stopping the flywheel.

* * * * *